United States Patent [19]

Brett

[11] 3,999,183

[45] Dec. 21, 1976

[54] FLOATABLE RADIO ANTENNA

[75] Inventor: John Golden Brett, Northampton, England

[73] Assignee: Plessey Handel und Investments A.G., Zug., Switzerland

[22] Filed: June 19, 1975

[21] Appl. No.: 588,241

[30] Foreign Application Priority Data

June 24, 1974 United Kingdom ..... 27985/74

[52] U.S. Cl. ..... 343/709; 343/899

[51] Int. Cl.[2] ..... H01Q 1/34

[58] Field of Search ..... 343/709, 710

[56] References Cited

UNITED STATES PATENTS

| | | | |
|---|---|---|---|
| 2,049,588 | 8/1936 | Leib | 343/709 |
| 3,806,927 | 4/1974 | Lane, Jr. | 343/709 |
| 3,911,441 | 10/1975 | Stein | 343/709 |

*Primary Examiner*—Alfred E. Smith
*Assistant Examiner*—David K. Moore
*Attorney, Agent, or Firm*—Fleit & Jacobson

[57] ABSTRACT

A floatable radio antenna (releasable from a submarine) includes a solid hemisphere of conductive material concentric with a hollow hemisphere of dielectric material. The hemispheres are contained in a floatation jacket which carries them above the surface of a liquid on which the jacket floats. Concentric spheres may be used if desired. The dielectric material permits an antenna of small physical dimensions.

4 Claims, 2 Drawing Figures

FLOATABLE RADIO ANTENNA

This invention relates to radio antennae with particular reference to their use for communicating with submerged stations such as submarines.

According to the invention there is provided a floatable radio antenna, capable of floating on a surface of a liquid with at least part of the antenna projecting above the surface, which includes: a mass of conductive material presenting a solid hemisphere projecting above a datum plane parallel to the surfaces of the liquid; and a mass of dielectric material presenting a hollow hemisphere projecting above said datum plane, the hollow hemisphere and the solid hemisphere being concentric, and the inner curved surface of the hollow hemisphere being in contact with the curved surface of the solid hemisphere.

Figure 1:
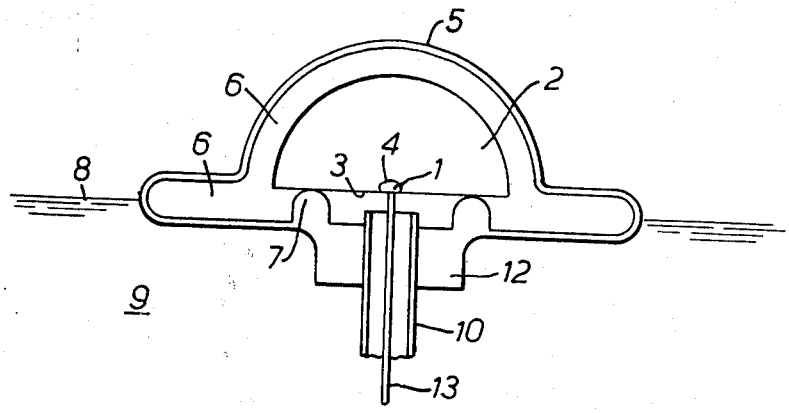
Figure 2:
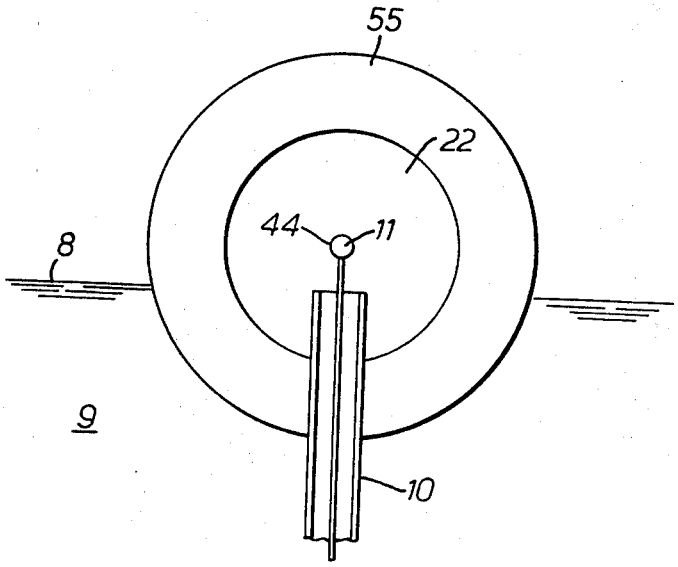

The invention will now be described with reference to the accompanying drawings in which FIGS. 1, 2 are cross-sections of frist and second embodiments, respectively of the invention.

FIG. 2 is the drawing which accompanies the British provisional specification, with the references altered to be compatible with those used in FIG. 1.

The first embodiment includes a solid hemisphere 1 of electrically conductive material and a hollow hemisphere 2 of dielectric material. The hemispheres are concentric and have their flat surfaces co-planar as shown at 3. The inner curved surface of the hollow hemisphere 2 is in contact with the curved surface of the solid hemisphere 1, as shown at 4. A floatation jacket 5, of any suitable material encloses the hemispheres and also a sufficient volume of air 6 to make the antenna buoyant. The jacket 5, which may have any convenient shape, offers internal supports 7 on which the hemispheres 1, 2 are mounted with the common plane 3 of their flat surfaces parallel to the surface 8 of the liquid 9 on which the antenna floats. One end of a cable 10 is received and sealed in a seating 12 of the floatation jacket 5. The other end of the cable 10 is located at the submerged station (not shown). The cable 10 has a conductive lead 13 one end of which is connected to the conductive hemisphere 1. The other end of the lead 13 is terminated at the submerged station (not shown).

In the second embodiment, both hemispheres are duplicated so as to provide a solid conductive sphere 11 enclosed by a hollow dielectric sphere 22. The spheres are concentric, and the inner surface of the hollow sphere 22 is in contact with the surface of the solid sphere 11, as shown at 44. A spherical floatation jacket 55, which is buoyant and waterproof and may be made of rubber, surrounds the spheres 11, 22. An end of the cable 10 penetrates the jacket 55 and is embedded in the dielectric sphere 22. An end of the conductive lead 13 is connected to the conductive sphere 11. The antenna floats on the surface 8 of the liquid 9. Alternatively the jacket may be buoyant and enclosed in a waterproof skin.

When radio communication with a submerged station, such as a submarine, is required, the submerged station releases the antenna and pays out the cable 10. On account of its buoyancy, the antenna rises till it floats on the surface 8 of the liquid 9 in which the station is submerged, with the plane 3 parallel to the surface 8 and the hemispheres 1, 2 projecting above the surface 8. Alternatively at least half of the spheres 11, 12 project above the surface 8. In passing between the conductive material 1, 11 and the atmosphere, the radio signals traverse the dielectric material 2, 22. The effect of the dielectric material is to reduce the size of antenna required. For example, a conventional 100MHz dipole antenna would be about 1½meters long. In a 100 MHz antenna according to the invention, the conductive hemisphere 1 or sphere 11 would be about 1cm in diameter. In the spherical antenna of FIG. 2, signals transmitted by the lower half of the antenna pass into the water, and, depending on the conductivity of the water, may not reach the distant station for which they are intended. Signals from the distant station are received through the atmosphere. In other words, the lower half of the spherical antenna may be largely redundant, and the hemispherical antenna of FIG. 1 may therefore represent a more efficient use of material.

The conductive material for the hemisphere 1 or sphere 11 may be metal. The dielectric material for the hemisphere 2 or sphere 22 may be that described in British Patent Application No. 40810/73.

It is to be understood that the foregoing description of specific examples of this invention is made by way of example only and is not to be considered as a limitation in its scope.

What is claimed is:

1. A floatable radio antenna, capable of floating on the surface of a liquid with at least part of the antenna projecting above the surface, which includes; a mass of conductive material presenting a solid hemisphere projecting above a datum plane parallel to the surface of the liquid; a mass of dielectric material presenting a hollow hemisphere projecting above said datum plane, the hollow hemisphere and the solid hemisphere being concentric, and the inner curved surface of the hollow hemisphere being in contact with the curved surface of the solid hemisphere; and a floatation jacket enclosing said hemispheres for floating the antenna on the surface of a liquid with said hemispheres projecting above said datum plane.

2. An antenna as claimed in claim 1 which includes a conductive lead connected at one end to the mass of conductive material, and extending thence below said datum plane.

3. An antenna as claimed in claim 1 in which the mass of conductive material is a solid sphere, and in which the mass of dielectric material is a hollow sphere, concentric with and enclosing the solid sphere.

4. An antenna as claimed in claim 3 which includes a conductive lead connected at one end to the mass of conductive material, and extending thence below said datum plane.

* * * * *